United States Patent [19]

Parrott

[11] Patent Number: 4,765,687

[45] Date of Patent: Aug. 23, 1988

[54] TIP AND MINERAL CUTTER PICK

[75] Inventor: George A. Parrott, Wakefield, England

[73] Assignee: Innovation Limited, Wakefield, England

[21] Appl. No.: 13,856

[22] Filed: Feb. 11, 1987

[30] Foreign Application Priority Data

Feb. 19, 1986 [GB] United Kingdom ..... 8604098

[51] Int. Cl.[4] ..... E21B 10/18; E21C 35/22

[52] U.S. Cl. ..... 299/81; 175/393

[58] Field of Search ..... 299/79, 81, 12, 17; 175/339, 393

[56] References Cited

U.S. PATENT DOCUMENTS

| | | | |
|---|---|---|---|
| 4,143,920 | 3/1979 | Haddock | 299/79 |
| 4,443,038 | 4/1984 | Brown | 299/81 |
| 4,529,250 | 7/1985 | Radford et al. | 299/81 |
| 4,573,744 | 3/1986 | Clemmow et al. | 299/81 |
| 4,652,056 | 3/1987 | Parrott et al. | 299/81 |

FOREIGN PATENT DOCUMENTS

| | | | |
|---|---|---|---|
| 0052978 | 2/1982 | European Pat. Off. . | |
| 1283777 | 11/1968 | Fed. Rep. of Germany . | |
| 2134893 | 2/1972 | Fed. Rep. of Germany . | |
| 3202315 | 7/1983 | Fed. Rep. of Germany . | |
| 2041043 | 9/1980 | United Kingdom | 299/81 |
| 2067625 | 7/1981 | United Kingdom . | |
| 2104945 | 3/1983 | United Kingdom . | |
| 2137263 | 10/1984 | United Kingdom . | |
| 495437 | 12/1975 | U.S.S.R. . | |

*Primary Examiner*—George A. Suchfield
*Assistant Examiner*—David J. Bagnell
*Attorney, Agent, or Firm*—Mason, Fenwick & Lawrence

[57] ABSTRACT

A mineral cutter tip 14 comprises a bottom face 15 and a rear face 16 located in "V"-formation whereby the tip 14 is, in use, seated in a "V"-notch 7 provided in a head 2 of a mineral cutter pick 1, the tip 14 further comprising a front cutting face 17 and, reawardly thereof, a water-conveying slit or slot 20 provided intermediate opposed, lateral side faces 19 of the tip 14, and having a water inlet end 23 emerging at the rear face 16 of the tip 14 and a water outlet end 24 emerging at the top face 18 of the tip 14. The invention also includes a pick 1 provided with a tip 14 as defined.

10 Claims, 5 Drawing Sheets

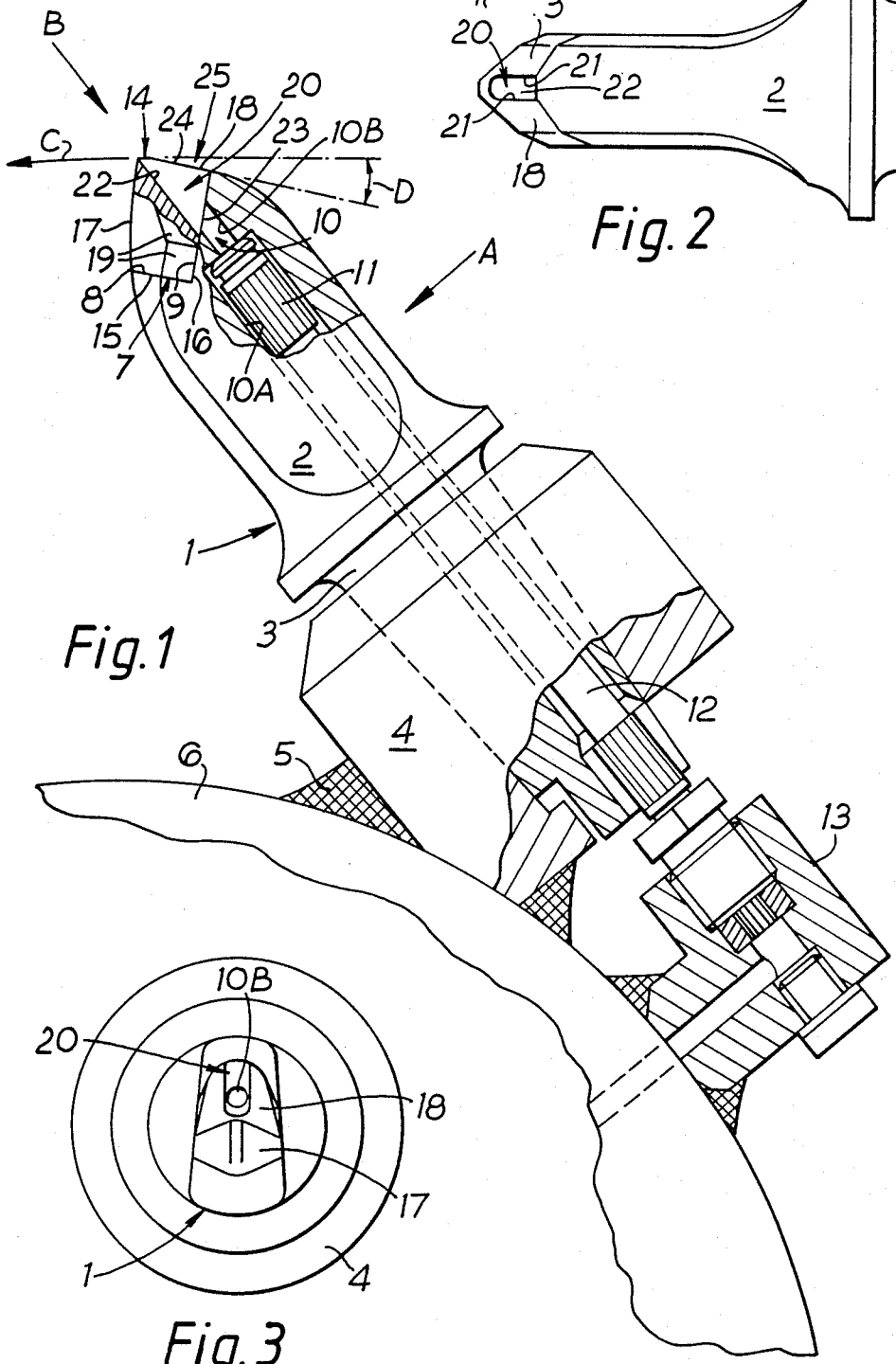
Fig. 1
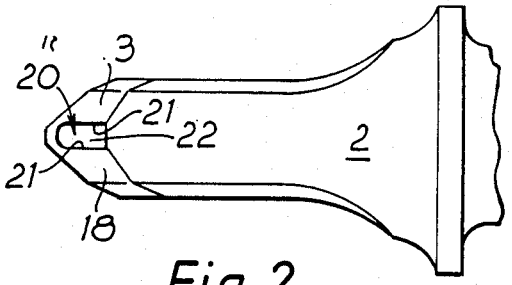
Fig. 2
Fig. 3

TIP AND MINERAL CUTTER PICK

This invention relates to a tip for a mineral cutter pick, and to a pick provided with such a tip.

Conventionally, a pick is of forged steel, comprising a head, which is usually enlarged, and a shank extending from the head, by which shank the pick is releasably mounted in a pick box secured, by welding, to a rotary cutting head. Furthermore, the pick is provided with a cutting tip of wear resistant material (usually tungsten carbide) brazed to the pick head. Multiple tips on a head are also known.

Various proposals have been made for passing water through the pick, specifically through one or more bores of the pick, to water spray/jet nozzles for purposes of dust suppression, pick cooling, incendive sparking elimation (see for example GB Nos. 2041043, 2088441, 2104945, DE No. 1283777, U.S. Pat. No. 3,747,982), with the nozzle(s) emerging in close proximity to the tip. Other proposals are disclosed in EU No. 0167236. One further proposal, considered as advantageously offering a tip cooling effect, was to provide a fine bore in the tip of a pick of the kind disclosed in GB No. 2113743A, for the water to be passed through the tip before discharge from the outlet end of the fine bore, which end emerges at a front, cutting face of the tip. Yet another proposal is described in GB No. 2087949B with multiple grooves or bores surrounding a tungsten carbide insert of a point attack pick. Such multiple supply ports demand subsantial water flow rates and hence pumping capacity and cost, whilst the disadvantage of excessive quantities of water deposited on a coal face have already been discussed. Of course, reducing the cross section of the supply ports would reduce water usage, but also as discussed above, finer ports are more prone to debris blockage, either externally from coal particles or internally from a contaminated water supply.

Whilst all the above proposals would in theory produce the results sought, the conditions encountered in service result in frequent nozzle blockage, with the finer nozzles, advantageous for economy of water use, understandably being more prone to blockage than the less water efficient larger diameter nozzles, whilst excessive water creates additional mineral conveying and other problems. Clearly, mineral production is correspondingly interrupted to effect nozzle unblocking or alternatively, the cutting head is deliberately and disadvantageously operated with blocked nozzles.

According to a first aspect of the present invention there is provided a mineral cutter tip comprising a bottom face and a rear face located in "V"-formation whereby the tip is, in use, seated in a "V"-notch provided in a head of a mineral cutter pick, the tip further comprising a front cutting face and, rearwardly thereof, a water-conveying slit or slot provided intermediate opposed, lateral side faces of the tip, and having a water inlet end emerging at the rear face of the tip and a water outlet end emerging at a top face of the tip.

According to a second aspect of the present invention there is provided a mineral cutter pick comprisinga pick headand a shank by which the pick isreleasably securable in a pick box, the head being provided with a tip as defined above, and also being provided with a water discharge nozzle so located with respect to the slit or slot as to direct water through or along the slit or slot to a clearance rake zone located rearwardly of the pick with respect to the direction of pick displacement is use and remote from the front cutting face.

Thus, the tip in accordance with the first aspect of the invention is itself subjected to the advantageous water cooling effect but, in contrast to the prior art proposal already described to achieve this effect, the rearward location of the slit or slot of the tip of the invention has been found to be the optimum position for water discharge to achieve enhanced pick performance. Furthermore, the rearward location of the slit or slot is such that debris does not tend to be compacted into it whilst the slot may have a relatively generous width, to reduce or eliminate potential blockage by debris, with no reduction of the water flow rate or pressure, because the cross section of the water discharge nozzle dictates the flow rate and pressure, with the slit or slot merely serving as a clearance channel for the flow of water to the clearance rake zone.

Comparative tests by an independant authority against the cutting performance of other picks in common use in UK coal mines has shown a remarkable and unexpected increase in pick life. Thus, picks in accordance with the invention have a life at least double that of the next best performing pick tested and five times the worst performing pick tested. In terms of cutting distances, picks in accordance with the invention were still cutting satisfactorily after 500 m, exhibiting minimal wear, while picks in common use in UK coal mines would need changing, because of excessive wear after approx 25 m in the case of dry picks and 100 m to 250 m in the case of wet picks jetting water at the front. It will be appreciated of course that as a pick wears, its cutting efficiency is reduced, and a correspondingly greater machine power is required to drive the pick(s) through the coal. But apart from reducing pick costs from viewpoints of purchase, transportation, fitting and down time and marginally increasing mineral production, by operating at cutting speeds for which the cutting head and machine were designed, the picks in accordance with the invention open up another advantageous possibility, previously unattainable without major re-designs of equipment, of increasing the pick cutting speed, which gives both a major increase in mineral production and a reduced torque requirement and hence reduced loading on the machine and the pick.

The reason for such an improvement in pick performance is not yet fully understood, but is doubtless relates to the lubricating effect of the water resulting from its chosen point of emission from the tip/pick in accordance with the invention. There may also be a cavitation effect within the slit or slot, with disturbance from imploding gas bubbles and a power multiplication effect by the impinging of a high pressure jet of water from the discharge nozzle onto a static water column within the slit or slot.

The tip would normally comprise a non-planar (e.g. curved) front cutting face, and a top face which defines a clearance rake angle. The bottom face would, in use, seat on a bottom seating surface machined or forged into the pick head, and the rear face would abut against a rear seating surface machined or forged into the pick head, the bottom and rear seating surfaces together forming a "V"-notch.

The water pressure may be at a relatively high level, e.g. 100–2000 bar, with a medium to higher pressure, say 350–2000 bar, if water jet assisted cutting is required. This last mentioned arrangement has been found to provide the further advantage of substantially reduced separation forces <60% compared with conventional pick arrangements, by what is believed to be an aquaplaning effect during cutting, between the top face of the pick and the mineral being cut. An ancillary advantage is that a proportion of the water film between the top face and mineral emerges forwardly of the tip and flushes mineral debris away from the front of the pick.

The slit may be for example 0.0625" wide, and there is no difficulty in producing such a tip with conventional powder technology.

With regard to the pick, this is of course provided with at least one bore connectable to a source of water pressure, the bore emerging at the rear seating face of the pick head, to discharge water into the slit or slot of the tip. The pick is non-rotatable, being of a radial type, and being provided with a rectangular shank and/or a tang (the latter if the pick has either a cylindrical.shank or a frusto-conically tapering shank) to prevent rotation and to give a pre-determined orientation with respect to its pick box.

The invention will now be further described by way of examples, with reference to the accompanying drawings, in which:

FIG. 1 is a side elevation of a first embodiment of a tip and pick in accordance with the two aspects of the present invention;

FIG. 2 is a view on the head portion of the pick of FIG. 1, in the direction of arrow A;

FIG. 3 is a view in the direction of arrow B of FIG. 1;

Figure 6:
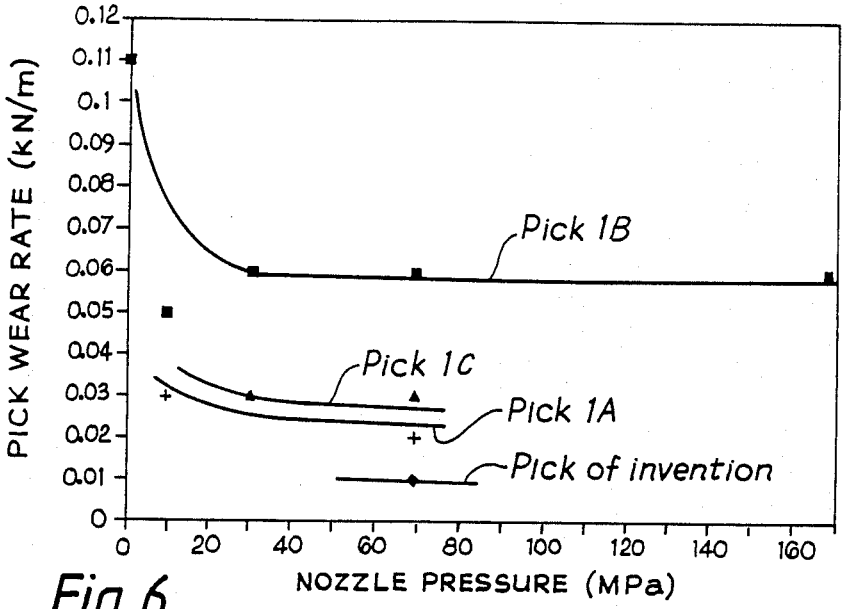
FIG. 6 is a graph illustrating the test results on the wear rate of the tested picks at a cutting speed of 0.5 m/s.
Figure 7:
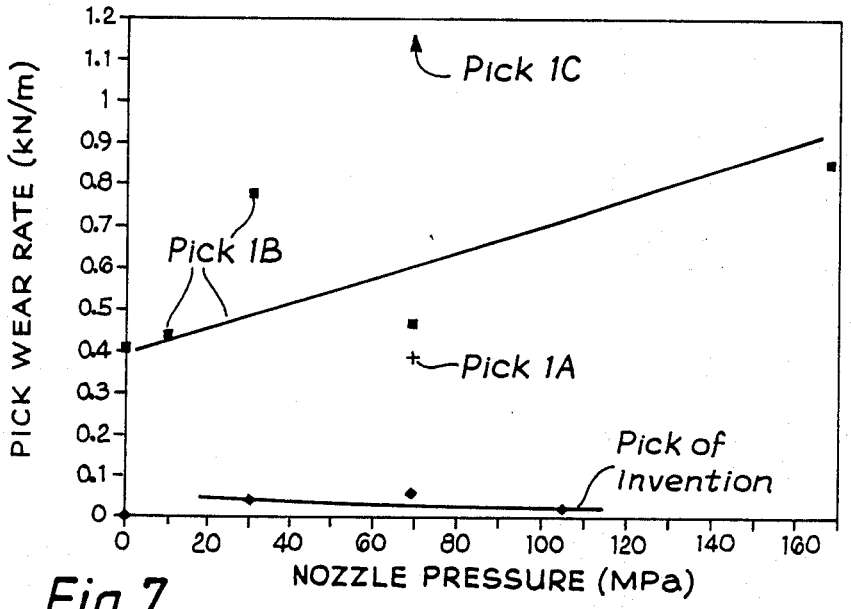
Figure 8:
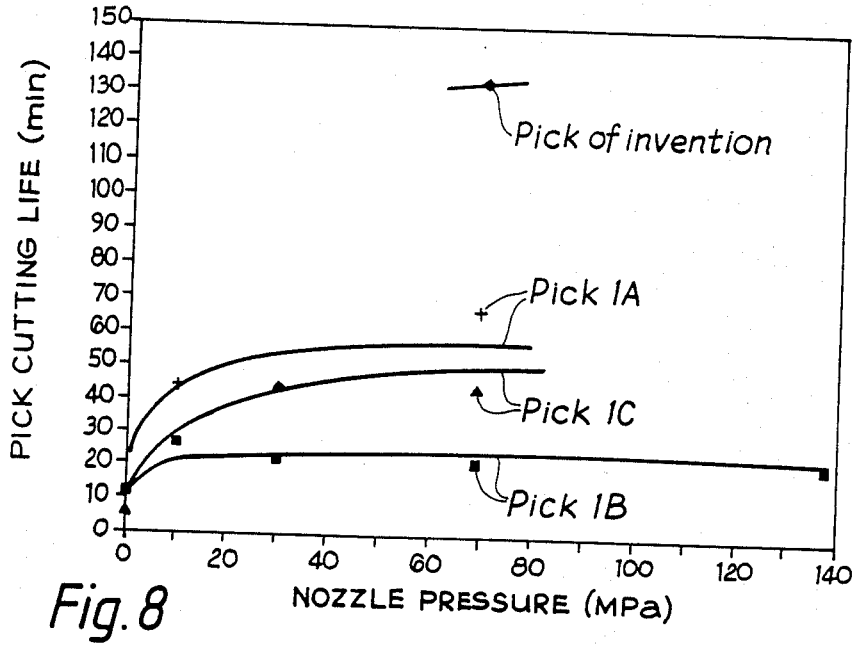
Figure 9:
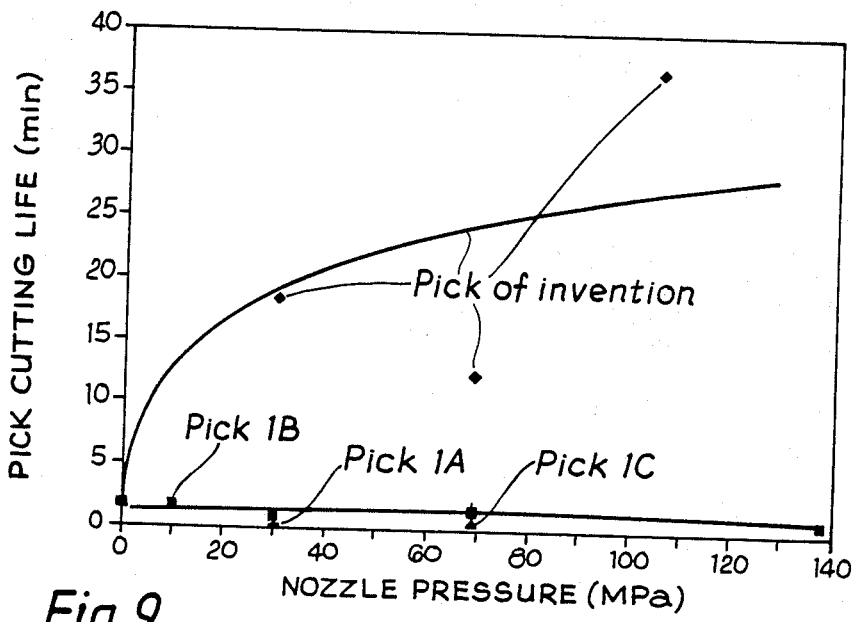

FIG. 7 corresponds to FIG. 6 but at a cutting speed of 0.9 m/s;

FIG. 8 is a further graph illustrating the effect of the selected water emission position on pick life at a cutting speed of 0.5 m/s;

FIG. 9 corresponds to FIG. 8 but is at a cutting speed of 0.9 m/s; and

Figure 10:
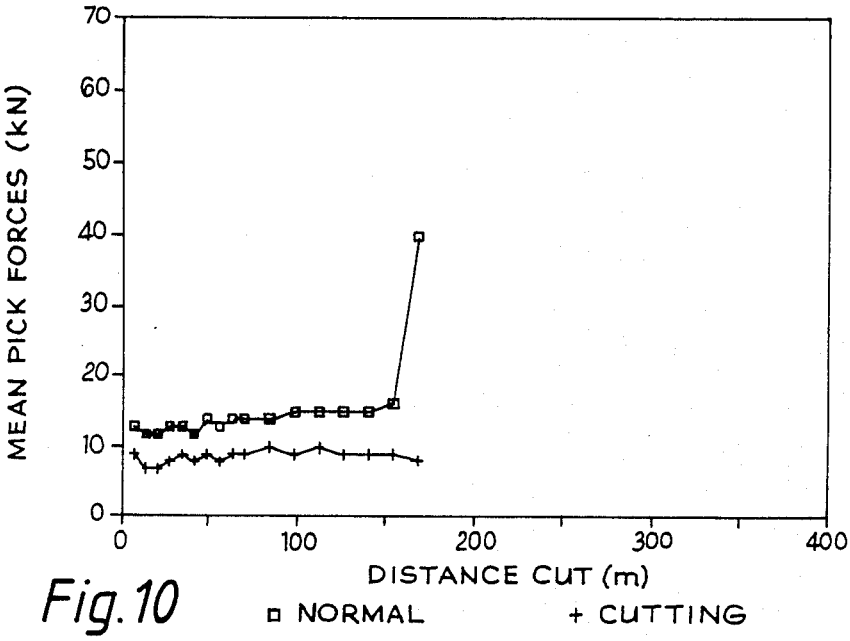

FIG. 10 is a graph illustrating the effect of water removal from a pick in accordance with the invention.

In the drawings is illustrated a mineral cutter pick 1, of the radial type, being non-rotatable, having a head 2 and a shank 3 by which it isreleasably mountedina pick box 4 secured by weld metal 5 to a portion of a rotary cutting head 6, and hence being displaceable in the direction of arrow C. The cutting head 6 is, in use, mounted either on a shearer type mining machine, if coal winning operations are involved, or on a road header type machine, if roadway or tunnel driving is involved.

Figure 4:
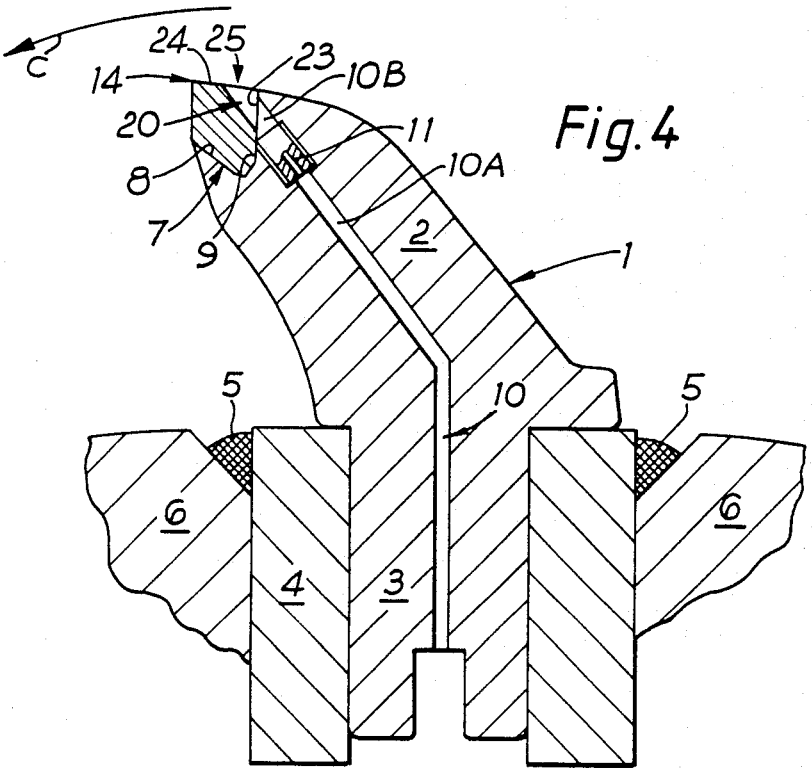
FIG. 4 is a side elevation of a second embodiment of a tip and pick in accordance with the two aspects of the present invention.

Remote from the shank 3, the head 2 is provided with a "V"-notch 7 comprising a bottom seating surface 8 and a rear seating suface 9, the notch 7 of the embodiment of FIGS. 1 to 3 being at 90°, and the notch 7 of the embodiment of FIG. 4 being at 45°. The head 2 is provided with a bore 10 connectable to a source of water pressure (not illustrated but conveniently a pump on board an associated mining machine). In the embodiment of FIGS. 1 to 3 the bore 10 has a first bore part 10A of larger diameter than a second bore part 10B. In the first bore part 10A is housed a water discharge nozzle 11, of the kind described in detail in EU No. 0167236, is mounted on one end of a flexible lance 12 extending from the water discharge nozzle 11 to a housing 13 containing water supply porting, whilst the second bore part 10B emerges at the rear seating surface 9.

As best seen in FIGS. 1 to 3, a tip 14, of hard material e.g., tungsten carbide is secured, e.g., by brazing, in the "V"-notch 7, the tip having a bottom face 15, to seat on the bottom seating surface 8, a rear face 16, to abut against the rear seating surface 9, so that consequently the faces 15 and 16 are located in "V"-formation. The tip 14 is also provided with a curved, front cutting face 17, a top face 18 which has a clearance rake angle D, and lateral side faces 19. A slit or slot 20 generally of square "U"-shape is defined between spaced apart sidewalls 21, which may be parallel or mutually tapering and a bottom wall 22. The slit or slot 20 extends from the rear face 16 to the top face 18, and is contiguous with the second bore part 10A, and hence has a water inlet end 23 adjacent the rear face of the "V"-notch 7 and a water outlet end 24 emerging at the top face 18 of the tip. Hence, in use, a water jet emitted by the water discharge nozzle 11 passes through the second bore part 10B and into and along the slit or slot 20, to emerge at a clearance rake zone 25 located rearwardly of the pick 1 and its tip 14.

In the embodiment of FIG. 4 the bore 10 extends through both the head 2 and the shank 3 of the pick with, in this embodiment, the first bore part 10A of smaller diameter than the second bore part 10B which is tapped to receive a screw-in water discharge nozzle 11, from which water is directed into the slit or slot 19 to emerge, as before, at the clearance rake zone 25.

Figure 5:
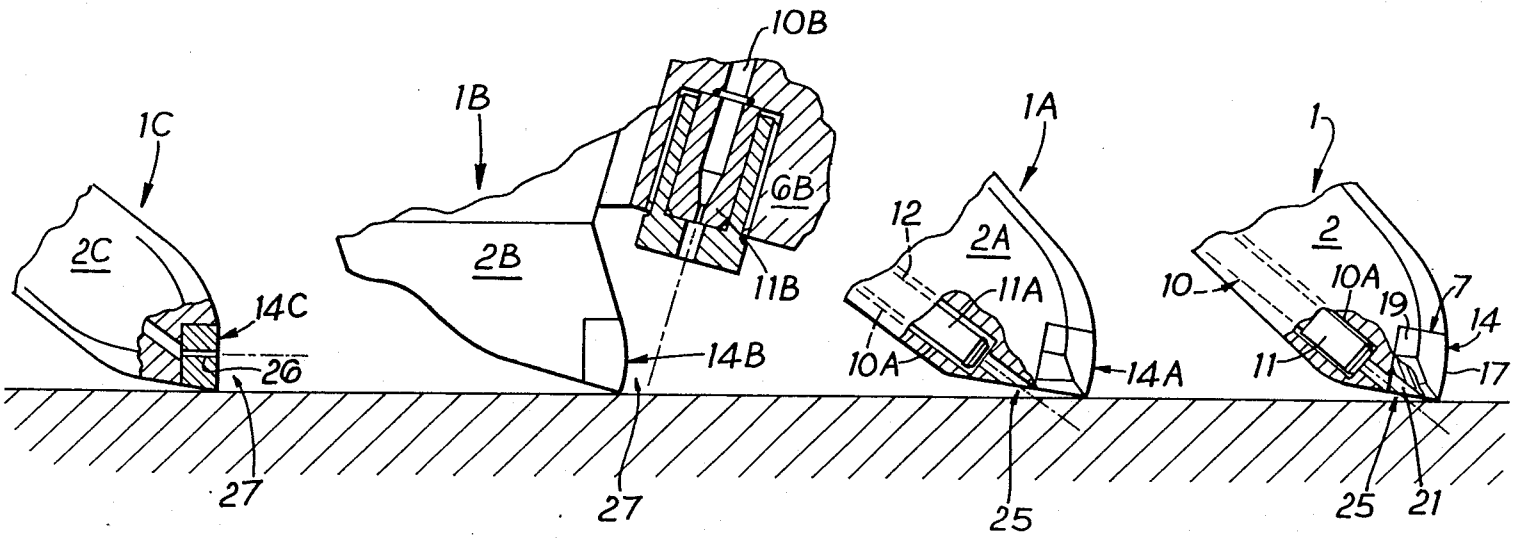
FIG. 5 illustrates a pick in accordance with FIG. 1 and 3 known picks undergoing comparative cutting tests.

In FIG. 5 is illustrated at 2 the head of a pick 1 in accordance with FIGS. 1 to 3. At 2A is illustrated the head of a known pick 1A in accordance with EU No. 0167236 of the present Applicants. At 2B is illustrated the head a known industry-standard pick 1B. At 2C is illustrated the head of a known pick 1C, and generally as described in GB No. 2113743A, but with a fine bore 26 through its tip 14C.

It will be observed that although pick 1A discharges water to the clearance rake zone 25, such discharge is not through a slit or slot 20 provided in its carbide tip 14A, as taught by the present invention, but on the contrary is to the rear of its tip 14A, whereas picks 1B and 1C discharge water into a zone 27 forwardly of their respective tips 14B, 14C.

FIGS. 6 and 7 indicate clearly the substantially reduced rate of wear of a pick in accordance with the invention compared with the three test picks 1A, 1B, 1C, at 69 MPa. FIGS. 8 and 9 illustrate the superiority of the rearward water discharge of picks 1 and 1A, compared with the forward water discharge of picks 1B and 1C and the even better performance of pick 1, compared with pick 1A in advancing the area of water discharge towards the front cutting face 17, and through the slit or slot 20 to give efficient tip cooling.

Finally FIG. 10 is concerned solely with a pick 1 in accordance with the invention and illustrates the critical nature of the water supply requirement to the clearance rake zone 15 via the slit or slot 20 when, after a cutting distance of 150m, the water supply to the pick was cut-off which instantly elevated the normal pick force (of the two pick force components, normal and cutting, that are present) from approximately 15 kN to approximately 40 kN. As a rotary cutting head will carry at least 25–50 picks, the significance of the relatively low normal pick force resulting from the tip and pick in accordance with present invention can be appreciated.

What I claim is:

1. A mineral cutter tip comprising a bottom face and a rear face located in "V"-formation whereby said tip is, in use, seated in a "V"-notch provided in a head of a mineral cutter pick, said tip further comprising a front cutting face, a top face and opposed, lateral side faces and, rearwardly of said front cutting face having regard to the direction of displacement of said tip and pick, in use, there is provided a water-conveying slit between said lateral side faces, with a water inlet end of said slit emerging at said rear face of said tip and a water outlet end emerging at said top face of said tip.

2. A tip as claimed in claim 1, wherein said front cutting face is non-planar.

3. A tip as claimed in claim 1, wherein said slit is of square "U"-shape defined between two spaced-apart side walls, and a bottom wall.

4. A tip as claimed in claim 1, of tungsten carbide.

5. A mineral cutter pick comprising a pick head and a shank by which the pick is releasably securable in a pick box, the head being provided with a tip comprising a bottom face and a rear face located in "V"-formation whereby said tip is, in use, seated in a "V"-notch provided in a head of a mineral cutter pick, said tip further comprising a front cutting face, a top face and opposed, lateral side faces and, rearwardly of said front cutting face having regard to the direction of displacement of said tip and pick, in use, there is provided a water-conveying slit between said lateral side faces, with a water inlet end of said slit emerging at said rear face of said tip and a water outlet end emerging at said top face of said tip, and said pick also being provided with a water discharge nozzle so located with respect to said slit as to direct water through and along said slit to a clearance rake zone located rearwardly of said pick, with respect to the direction of pick displacement, in use, and remote from said front cutting face of said tip.

6. A pick as claimed in claim 5, wherein a "V"-shaped notch is provided in an end of said pick head remote from said shank to receive said tip.

7. A pick as claimed in claim 5, provided with a bore connectable to a source of water pressure.

8. A pick as claimed in claim 7, wherein said bore comprises a first bore part and a second bore part of differing diameters.

9. A pick as claimed in claim 8, wherein a larger diameter bore part houses said water discharge nozzle with a flexible lance attached to said discharge nozzle.

10. A pick as claimed in claim 8, wherein a larger diameter bore part is tapped and a screw-in water discharge nozzle is located in said larger diameter bore.

* * * * *